US006648434B2

(12) United States Patent
Walker et al.

(10) Patent No.: US 6,648,434 B2
(45) Date of Patent: Nov. 18, 2003

(54) DIGITALLY COMPENSATED PRESSURE INK LEVEL SENSE SYSTEM AND METHOD

(75) Inventors: Ray A. Walker, Eugene, OR (US); Rhonda L. Wilson, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 60 days.

(21) Appl. No.: 09/802,682

(22) Filed: Mar. 8, 2001

(65) Prior Publication Data

US 2002/0126164 A1 Sep. 12, 2002

(51) Int. Cl.[7] ..... B41J 2/195
(52) U.S. Cl. ..... 347/7
(58) Field of Search ..... 347/7, 6, 20, 5, 347/1, 68, 95, 48, 98, 139 R; 73/861

(56) References Cited

U.S. PATENT DOCUMENTS

| | | | | |
|---|---|---|---|---|
| 4,587,535 A | | 5/1986 | Watanabe | |
| 4,639,738 A | * | 1/1987 | Young et al. | 346/75 |
| 4,973,993 A | | 11/1990 | Allen | |
| 5,491,540 A | | 2/1996 | Hirst | |
| 5,574,484 A | | 11/1996 | Cowger | |
| 5,583,545 A | | 12/1996 | Pawlowski, Jr. et al. | |
| 5,682,140 A | | 10/1997 | Christensen et al. | |
| 5,699,091 A | | 12/1997 | Bullock et al. | |
| 5,788,388 A | | 8/1998 | Cowger et al. | |
| 5,812,156 A | | 9/1998 | Bulluck et al. | |
| 5,835,817 A | | 11/1998 | Bullock et al. | |
| 5,930,553 A | | 7/1999 | Hirst et al. | |
| 6,039,430 A | | 3/2000 | Helterline et al. | |
| 6,113,208 A | | 9/2000 | Benjamin et al. | |
| 6,126,265 A | | 10/2000 | Childers et al. | |
| 6,151,039 A | | 11/2000 | Hmelar et al. | |

FOREIGN PATENT DOCUMENTS

| | | | | |
|---|---|---|---|---|
| DE | 3708865 A1 | | 10/1987 | |
| EP | 0 703 080 A2 | * | 3/1996 | 347/55 |
| EP | 0840098 A2 | | 5/1998 | |
| EP | 1203666 A1 | | 5/2002 | |

* cited by examiner

*Primary Examiner*—Raquel Yvette Gordon

(57) ABSTRACT

A printing system includes an inkjet printhead for selectively depositing ink drops on print media. An ink reservoir stores ink to be provided to the inkjet printhead. An ink level sensing circuit provides an ink level sense output that is indicative of a sensed volume of ink in the ink reservoir. A memory device stores sensor compensation information. A processor responsive to output of the memory device and the ink level sense output generates a compensated ink level sense output. The processor provides an estimate of available ink based on the compensated ink level sense output.

18 Claims, 5 Drawing Sheets

DIGITALLY COMPENSATED PRESSURE INK LEVEL SENSE SYSTEM AND METHOD

THE FIELD OF THE INVENTION

The present invention relates to printers and to ink supplies for printers. More particularly, the invention relates to a pressure ink level sensing system including a digital compensation system for an ink supply.

BACKGROUND OF THE INVENTION

The art of inkjet technology is relatively well developed. Commercial products such as computer printers, graphics plotters, and facsimile machines have been implemented with inkjet technology for producing printed media. Generally, an inkjet image is formed pursuant to precise placement on a print medium of ink drops emitted by an ink drop generating device known as an inkjet printhead assembly. An inkjet printhead assembly includes at least one printhead. Typically, an inkjet printhead assembly is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Inkjet printers have at least one ink supply. An ink supply includes an ink container having an ink reservoir. The ink supply can be housed together with the inkjet printhead assembly in an inkjet cartridge or pen, or can be housed separately. When the ink supply is housed separately from the inkjet printhead assembly, users can replace the ink supply without replacing the inkjet printhead assembly. The inkjet printhead assembly is then replaced at or near the end of the printhead life, and not when the ink supply is replaced.

For some hard copy applications, such as large format plotting of engineering drawings and the like, there is a requirement for the use of much larger volumes of ink than can be contained within inkjet cartridges housing an inkjet printhead assembly and an ink supply. Therefore, relatively large, separately-housed ink supplies have been developed.

In an inkjet device, it is desirable to know the level of the ink supply so that the inkjet printhead assembly is not operated in an out-of-ink condition. Otherwise, printhead damage may occur as a result of firing without ink, and/or time is wasted in operating a printer without achieving a complete printed image, which is particularly time consuming in the printing of large images which often are printed in an unattended manner on expensive media.

Some existing systems provide each ink container with an on-board memory chip to communicate information about the contents of the container. The on-board memory typically stores information such as manufacture date (to ensure that excessively old ink does not damage the print head,) ink color (to prevent misinstallation,) and product identifying codes (to ensure that incompatible or inferior source ink does not enter and damage other printer parts.). Such a chip may also store other information about the ink container, such as ink level information. The ink level information can be transmitted to the printer to indicate the amount of ink remaining. A user can observe the ink level information and anticipate the need for replacing a depleted ink container.

In one prior art ink level sensing (ILS) technique, a coil is positioned on each side of the ink reservoir. One coil acts as a transmitter, and the other coil acts as a receiver. As the ink in the ink reservoir is used up, the reservoir collapses and the coils come closer together. Signal level in the receiver provides a measure of the ink level in the ink reservoir. The coils function as a non-contacting inductive transducer that indirectly senses the amount of ink in the ink reservoir by sensing the separation between the opposing walls of the reservoir. An AC excitation signal is passed through one coil, inducing a voltage in the other coil, with a magnitude that increases as the separation decreases. The change in voltage in the coil results from the change in the mutual inductance of the coils with change in the separation between the coils. The output voltage is readily related to a corresponding ink volume. The use of this ILS technique is relatively expensive, however, and typically results in about 60 cc of stranded ink.

In a second technique, a pressure ink level sensing (P-ILS) system is used to sense ink level. A P-ILS system has the potential advantage of 50% less cost, and typically strands about 50% less ink than the coil ILS technique. However, P-ILS systems require a compensation system to compensate or correct the output of a pressure sensor. Existing compensation systems use resistors or similar means to set compensation values. The resistors are typically laser trimmed or mechanically trimmed to provide the desired compensation values, which is a relatively complex process. In addition, the compensation resistors require space on the integrated assembly, making it more difficult to reduce the size of the assembly There is a need for a pressure ink level sensing (P-ILS) system that includes a compensation system without the disadvantages of prior compensation systems.

SUMMARY OF THE INVENTION

The present invention provides a printing system that includes an inkjet printhead for selectively depositing ink drops on print media. An ink reservoir stores ink to be provided to the inkjet printhead. An ink level sensing circuit provides an ink level sense output that is indicative of a sensed volume of ink in the ink reservoir. A memory device stores sensor compensation information. A processor responsive to output of the memory device and the ink level sense output generates a compensated ink level sense output. The processor provides an estimate of available ink based on the compensated ink level sense output.

One aspect of the invention is directed to an ink container for an inkjet printing system having an inkjet printhead that selectively deposits ink drops on print media. The ink container includes an ink reservoir for storing ink to be provided to the inkjet printhead. A sensor provides an ink level sense signal that is utilized by a controller. An information storage device stores sensor compensation information that is utilized by the controller to provide a compensated ink level sense signal.

Another aspect of the invention is directed to a method for determining an amount of ink remaining in an ink container installed in a printing system having an inkjet printhead for receiving ink from the ink container and selectively depositing ink drops on print media. An ink level sense signal is provided that is indicative of a sensed volume of ink in the ink container. Digital compensation values are also provided. Compensated ink level sense values are generated based on the ink level sense signal and the digital compensation values. The amount of ink remaining in the ink container is calculated based on the compensated ink level sense values.

DESCRIPTION OF THE PREFERRED EMBODIMENTS

In the following detailed description of the preferred embodiments, reference is made to the accompanying drawings that form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

The P-ILS system of the present invention will be discussed in the context of a printer/plotter with an ink supply housed separately from an inkjet printhead assembly. However, it will be understood by those of ordinary skill in the art that the techniques described herein are also applicable to other devices employing inkjet technology with ink supplies housed either separately from or together with inkjet printhead assemblies, including, but not limited to, computer printers and facsimile machines.

Figure 1:
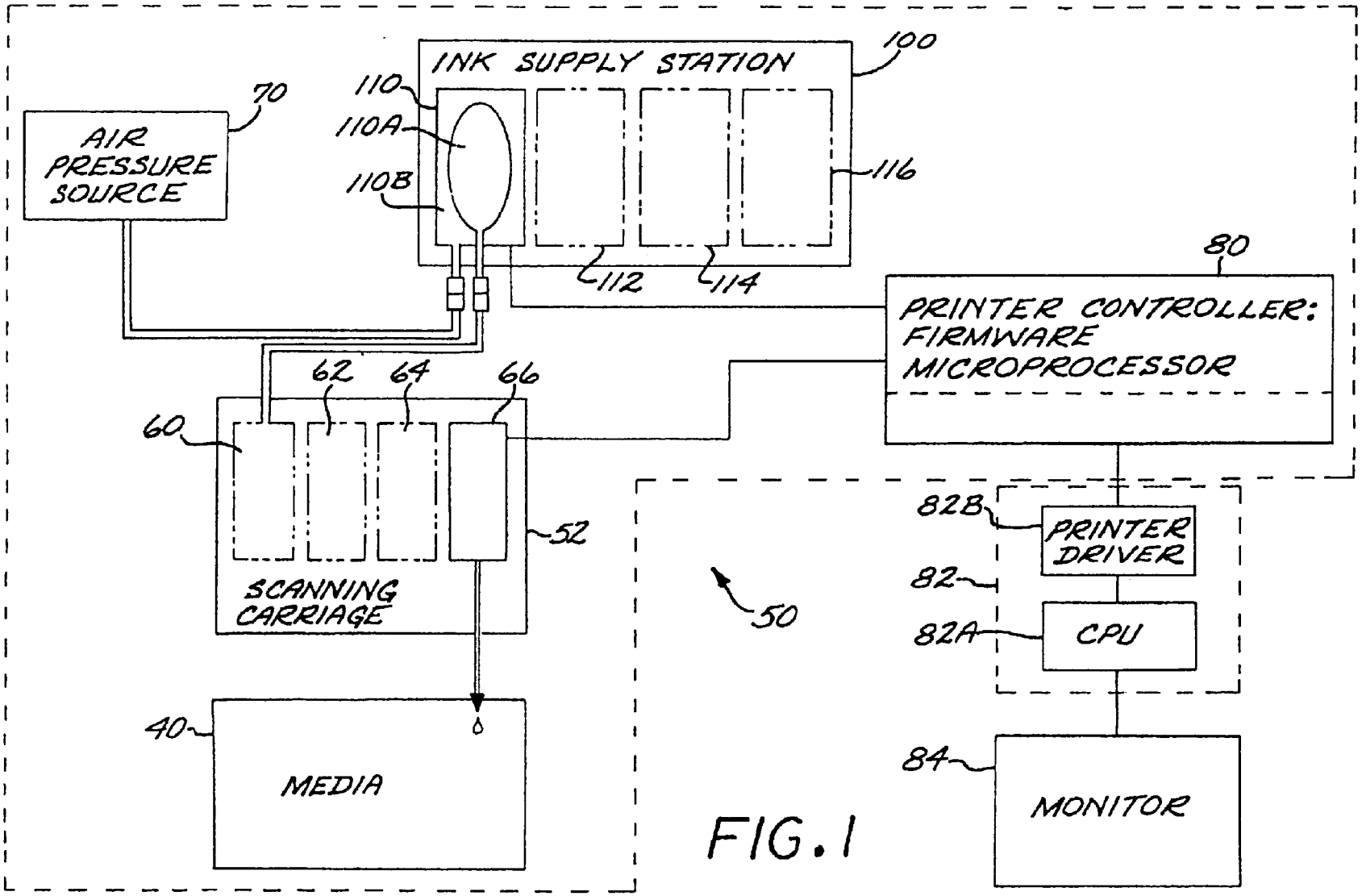
FIG. 1 illustrates a block diagram of a printer/plotter system in which the present invention can be incorporated.

FIG. 1 illustrates a block diagram of a printer/plotter 50 in which the present invention can be employed. Such a printer/plotter is described in commonly-assigned U.S. Pat. No. 6,151,039 to Hmelar, which is hereby incorporated by reference. The Hmelar patent also discloses a technique for ink level estimation using an ink level sensor. In one embodiment, the ink level sensor in Hmelar is a two-coil sensor, which was described above in the Background of the Invention section.

Figure 2:
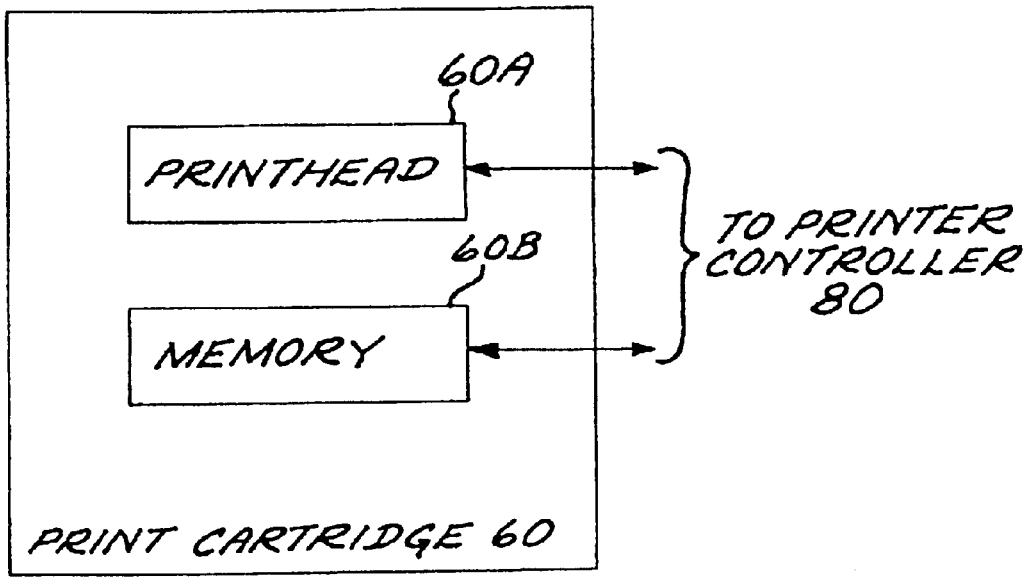
FIG. 2 illustrates a block diagram depicting major components of one of the print cartridges of the printer/plotter system of FIG. 1.

As shown in FIG. 1, a scanning print carriage 52 holds a plurality of printer cartridges 60–66, which are fluidically coupled to an ink supply station 100 that supplies pressurized ink to printer cartridges 60–66. In one embodiment, each of the cartridges 60–66 comprises an inkjet printhead and an integral printhead memory, as schematically depicted in FIG. 2. As shown in FIG. 2, printer cartridge 60 includes an inkjet printhead 60A and an integral printhead memory 60B. The ink provided to each of the cartridges 60–66 is pressurized to reduce the effects of dynamic pressure drops.

Ink supply station 100 contains receptacles or bays for accepting ink containers 110–116, which are respectively associated with and fluidically connected to respective printer cartridges 60–66. Each of the ink containers 110–116 includes a collapsible ink reservoir, such as collapsible ink reservoir 110A that is surrounded by an air pressure chamber 110B. An air pressure source or pump 70 is in communication with air pressure chamber 110B for pressurizing the collapsible ink reservoir 110A. In one embodiment, one pressure pump 70 supplies pressurized air for all ink containers 110–116 in the system. Pressurized ink is delivered to the printer cartridges 60–66 by an ink flow path that includes, in one embodiment, respective flexible plastic tubes connected between the ink containers 110–116 and respectively associated printer cartridges 60–66.

Figure 3:
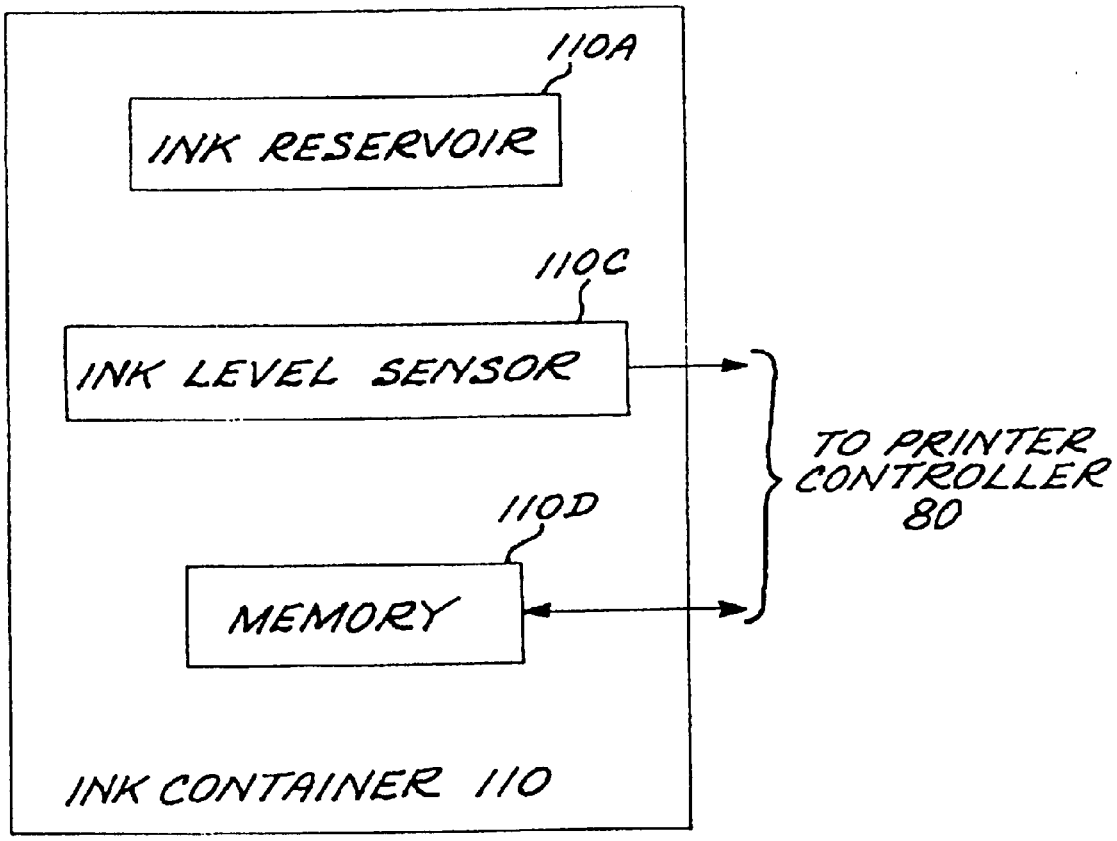
FIG. 3 illustrates a block diagram depicting major components of one of the ink containers of the printer/plotter system of FIG. 1.

In one embodiment, each of the ink containers 110–116 comprises an ink reservoir 110A, an ink level sensor 110C, and an integral ink cartridge memory 110D, as schematically depicted in FIG. 3 for ink container 110.

Referring again to FIG. 1, scanning print carriage 52, printer cartridges 60–66, and ink containers 110–116 are electrically interconnected to printer microprocessor controller 80. Controller 80 includes printer electronics and firmware for the control of various printer functions, including analog-to-digital (A/D) converter circuitry for converting the outputs of the ink level sensing circuits 110C of ink containers 110–116. In one embodiment, each one of the ink containers 110–116 includes its own A/D converter for converting the output of ink level sensing circuit 110C to digital values. Controller 80 controls the scan carriage drive system and the printheads on the print carriage to selectively energize the printheads, to cause ink droplets to be ejected in a controlled fashion on the print media 40. Printer controller 80 further estimates remaining ink volume in each of the ink containers 110–116, as described more fully herein.

A host processor 82, which includes a CPU 82A and a software printer driver 82B, is connected to printer controller 80. In one embodiment, host processor 82 comprises a personal computer that is external to printer 50. A monitor 84 is connected to host processor 82, and is used to display various messages that are indicative of the state of the inkjet printer. Alternatively, the printer can be configured for stand-alone or networked operation wherein messages are displayed on a front panel of the printer.

Figure 4:
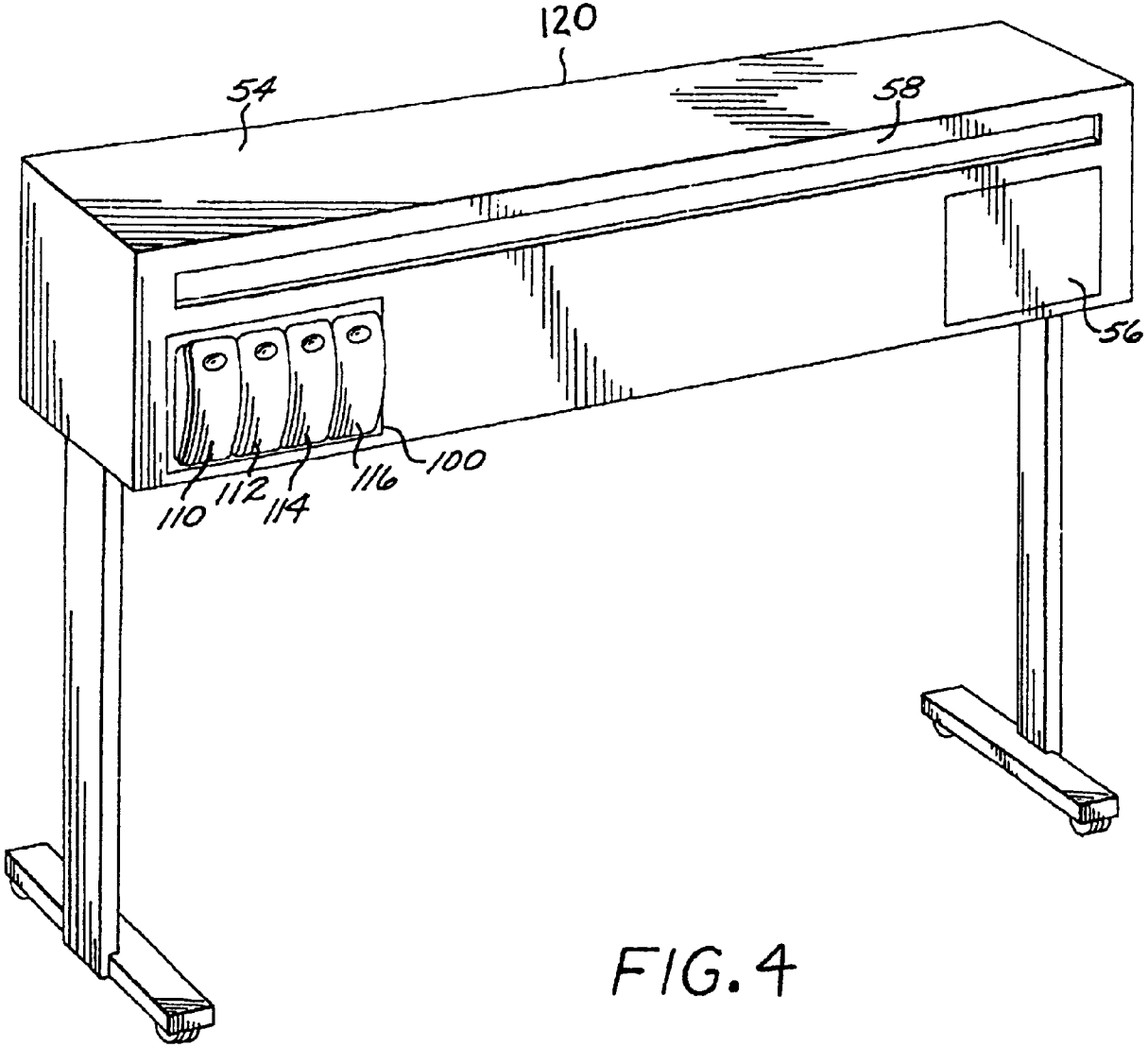
FIG. 4 illustrates a simplified isometric view of an implementation of the printer/plotter system of FIG. 1.

FIG. 4 shows in isometric view of a large format printer/plotter 120 in which the present invention can be employed. Printer/plotter 120 includes four off-carriage ink containers 110, 112, 114, 116, which are shown positioned in an ink supply station 100. The printer/plotter 120 of FIG. 4 further includes a housing 54, a front control panel 56, which provides user control switches, and a media output slot 58. While this exemplary printer/plotter 120 is fed from a media roll, it should be appreciated that alternative sheet feed mechanisms can also be used.

Ink level sensor 110C (shown in FIG. 3) is a preferably a pressure ink level sensor (P-ILS). In one embodiment, ink level sensor 110C uses a piezo-resistive strain gauge bridge to measure pressure. Such bridges, while low-cost and reliable, require compensation to produce a desired output. The compensation processes typically include offset correction, slope or gain adjustment, linearization correction, and temperature compensation.

Figure 5:
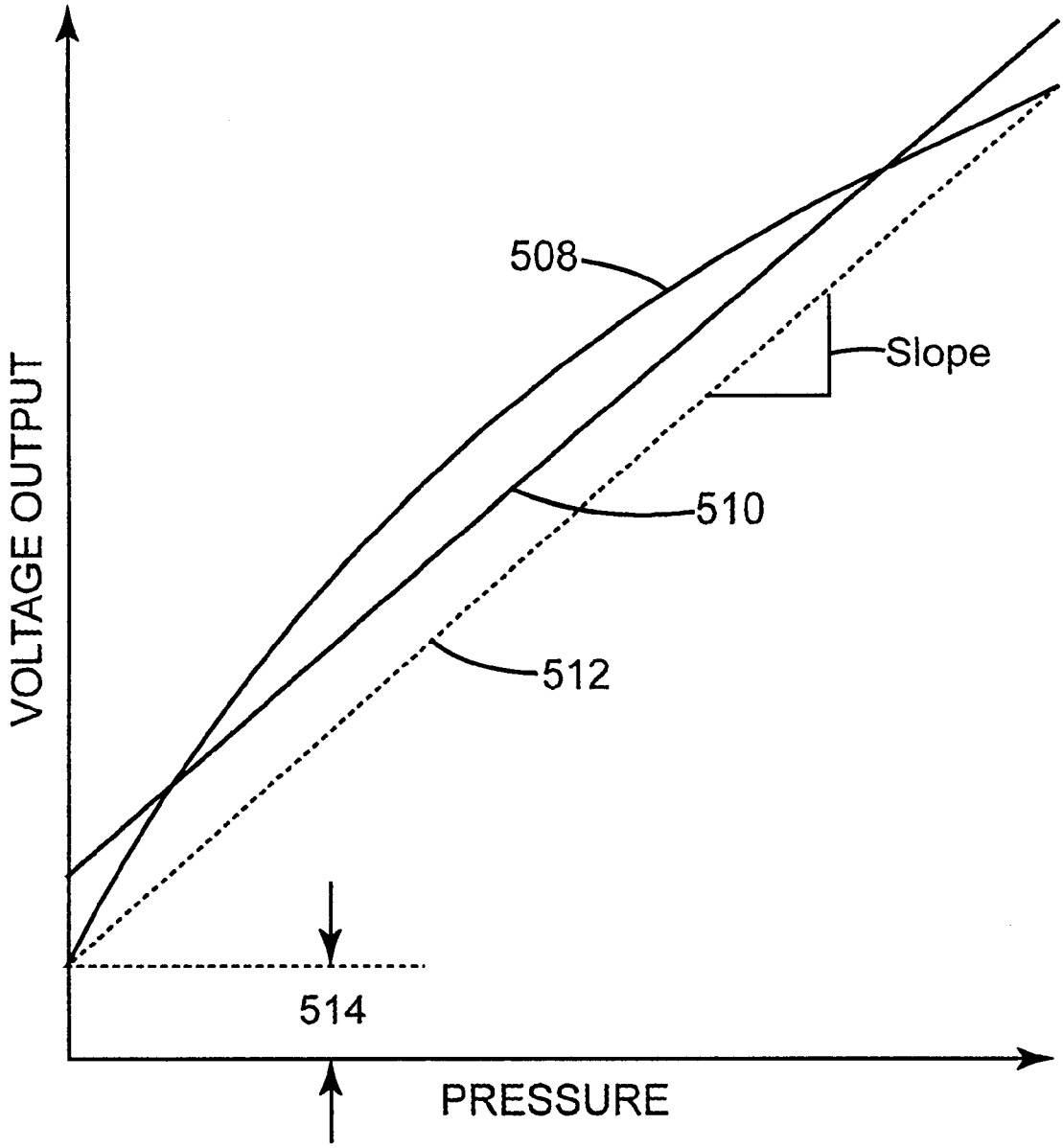
FIG. 5 illustrates a typical pressure sensor output, showing offset and non-linear response characteristics.

FIG. 5 illustrates a typical pressure sensor output 508 showing offset 514 and non-linear response characteristics. Compensation is used to produce a linear response, so that a given output voltage from ink level sensor 110C can be related to a predictable pressure value. FIG. 5 shows two examples of linearization approximations, which are a "Best Straight Line Fit" approximation represented by line 510 and a "Straight Line Fit" approximation represented by broken line 512.

Figure 6:
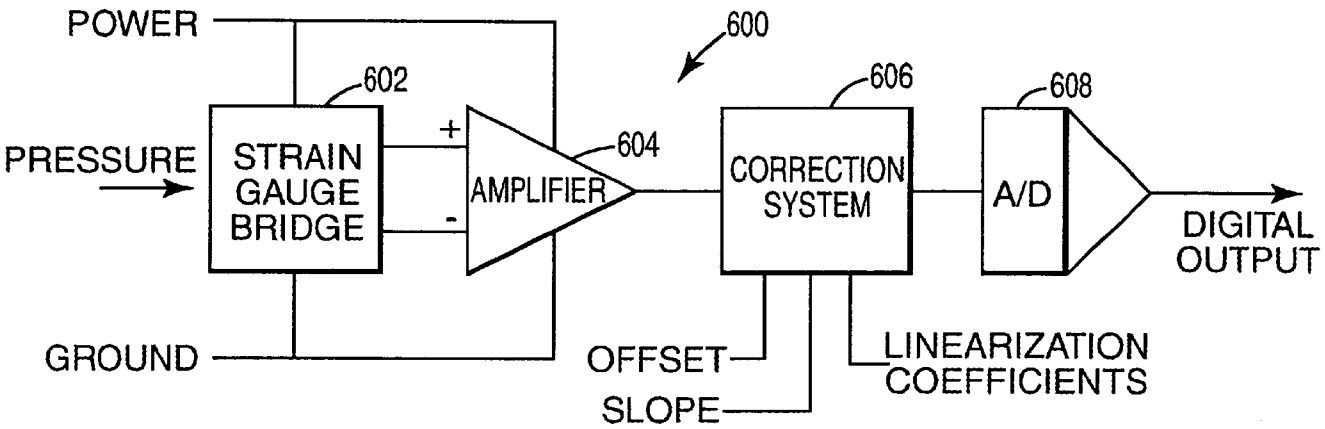
FIG. 6 illustrates a P-ILS system with an analog compensation system.

Pressure sensor compensation has previously been accomplished by an analog compensation system as shown in FIG. 6. P-ILS system 600 includes strain gauge bridge 602, differential amplifier 604, electronic correction system 606, and analog-to-digital (A/D) converter 608. The pressure applied to strain gauge 602 produces a differential output that is amplified by differential amplifier 604. The output from amplifier 604 is provided to electronic correction system 606. Electronic correction system 606 includes corrective inputs for offset, slope or gain, and linearization coefficients. Electronic correction system 606 modifies the uncompensated, amplified output from strain gauge 602 based on the offset, slope and linearization inputs to produce an analog compensated output.

The offset, slope and linearization inputs of correction system 606 are typically implemented using variable resistors. The variable resistors are set mechanically or trimmed automatically with lasers during manufacturing. The compensation resistors are trimmed to appropriate values based on characteristics of the sensor. The compensation resistors are then included as part of the pressure sensor assembly 600.

The analog compensated output from correction system 606 is converted to digital values by A/D converter 608 for use by printer controller 80 (shown in FIG. 1). Each digital value output by A/D converter 608 is proportional to an associated pressure measurement. Printer controller 80 uses the digital values output by A/D converter 608 to estimate the ink level in the associated one of ink containers 110–116.

Figure 7:
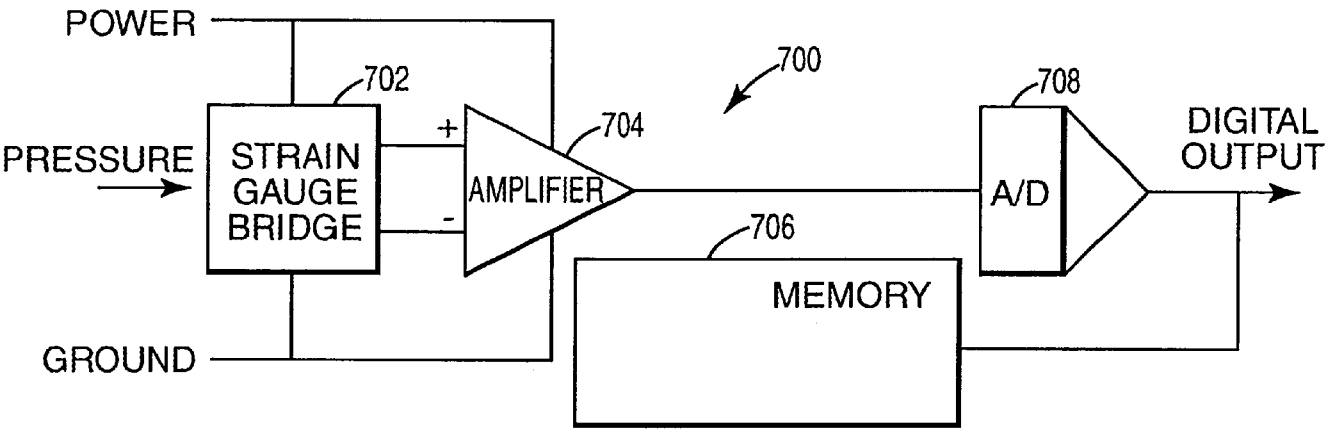
FIG. 7 illustrates a preferred P-ILS system according to the present invention, with a digital compensation system.

FIG. 7 illustrates a preferred P-ILS system 700 according to the present invention. Strain gauge bridge 702 and amplifier 704 function the same as described with respect to FIG. 6. Instead of modifying the amplifier output by a correction system 606 as in I-ILS system 600, P-ILS system 700 provides the output from amplifier 704 directly to A/D converter 708. Thus, the digital output produced by A/D converter 708 reflects uncorrected values with all of the offset, gain and non-linearization dependencies typically found in this sensor system.

During manufacture, the offset, gain and non-linearization correction components of P-ILS system 700 are determined based on characteristics of the sensor, just as in the analog system 600 of FIG. 6. Instead of requiring correction factors to be stored in hardware resistor values, the correction factors of P-ILS system 700 are determined and stored in the associated memory 706, which is integrated with the P-ILS system 700. Since memory 706 is an integral part of the ILS system, storing compensation values in memory 706 costs nothing in terms of physical space within the system, as the values are stored along with the traditional values associated with the ink container. In one embodiment, memory 706 is an EEPROM. In one embodiment, selected compensation values are determined and stored in memory 706 after manufacture of the device. As one example, the offset compensation value can be stored in memory 706 after insertion of the ink container in the printer. By storing the compensation values after manufacture of the device, any changes in the sensor characteristics that occur during or after manufacture of the device will be taken into account and corrected by the digital compensation system.

The positioning of memory 706 depends upon the particular printer configuration. In a system where the inkjet printhead assembly and the ink supply are separately housed, such as the system shown in FIG. 1, a memory 706 is preferably positioned with each one of ink containers 110–116 (e.g., positioned like memory 110D shown in FIG. 3). In a system where the inkjet printhead assembly and the ink supply are housed together in an inkjet cartridge, memory 706 is positioned with the inkjet cartridge.

In use, printer controller 80 addresses the integrated P-ILS system 700 digitally, and reads the digital output from the P-ILS system 700 and the compensation values stored in memory 706. Printer controller 80 compensates the digital output from A/D converter 708 using the compensation values obtained from memory 706, thereby producing a corrected pressure value for each sampled uncompensated pressure value. Printer controller 80 then estimates the ink level in the associated one of ink containers 110–116 based on the corrected pressure values. In one embodiment, the calculated ink level is output from printer controller 80 back to memory 706, where it is stored. Thus, even if the ink container with memory 706 is removed from the printer and put in a second printer, the ink level in the ink container is easily obtainable by the second printer.

The digital compensation system of the present invention provides several advantages over the analog compensation system shown in FIG. 6. Digital compensation values can be stored in memory 706 easier than analog resistors can be trimmed mechanically or automatically by laser trimmers. The cost of storing digital compensation values in memory 706 is less expensive than using on-board resistors or other on-board compensation components. Further, more elaborate compensation factors (such as a least-squares line fit) do not appreciably increase the cost of compensation.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An ink container for an inkjet printing system having a controller and an inkjet printhead that selectively deposits ink drops on print media, the ink container comprising:

an ink reservoir for storing ink to be provided to the inkjet printhead;

a sensor for providing an ink level sense signal that is utilized by the controller;

an information storage device storing sensor compensation information that is utilized by the controller to provide a compensated ink level sense signal;

wherein the sensor is a pressure sensor.

2. The ink container of claim 1, wherein the pressure sensor is a strain gauge bridge.

3. An ink container for an inkjet printing system having a controller and an inkjet printhead that selectively deposits ink drops on print media, the ink container comprising:

an ink reservoir for storing ink to be provided to the inkjet printhead;

a sensor for providing an ink level sense signal that is utilized by the controller;

an information storage device storing sensor compensation information that is utilized by the controller to provide a compensated ink level sense signal;

wherein the sensor compensation information is based on characteristics of the sensor.

4. An ink container for an inkjet printing system having a controller and an inkjet printhead that selectively deposits ink drops on print media, the ink container comprising:

an ink reservoir for storing ink to be provided to the inkjet printhead;

a sensor for providing an ink level sense signal that is utilized by the controller;

an information storage device storing sensor compensation information that is utilized by the controller to provide a compensated ink level sense signal;

wherein the sensor compensation information includes offset correction data, gain adjustment data, and linearization correction data.

5. A printing system comprising:

an inkjet printhead for selectively depositing ink drops on print media;

an ink reservoir for storing ink to be provided to the inkjet printhead;

an ink level sensing circuit for providing an ink level sense output that is indicative of a sensed volume of ink in the ink reservoir;

a memory device for storing sensor compensation information;

a processor responsive to output of the memory device and the ink level sense output for generating a compensated ink level sense output.

6. The printing system of claim 5, wherein the ink reservoir is replaceable separately from the printhead.

7. The printing system of claim 8, wherein the processor provides an estimate of available ink based on the compensated ink level sense output.

8. The printing system of claim 5, wherein the ink level sensing circuit includes a pressure sensor.

9. The printing system of claim 8, wherein the pressure sensor is a strain gauge bridge.

10. The printing system of claim 5, the sensor compensation information is based on characteristics of the ink level sensing circuit.

11. The printing system of claim 5, wherein at least a portion of the sensor compensation information is determined and stored in the memory device after attachment of the ink level sensing circuit to an ink container of the printing system.

12. The printing system of claim 5, wherein at least a portion of the sensor compensation information is stored in the memory device after installation of the ink level sensing circuit in the printing system.

13. The printing system of claim 5, wherein the sensor compensation information includes offset correction data, gain adjustment data, and linearization correction data.

14. A method for determining an amount of ink remaining in an ink container installed in a printing system having an inkjet printhead for receiving ink from the ink container and selectively depositing ink drops on print media, the method comprising:

providing an ink level sense signal that is indicative of a sensed volume of ink in the ink container;

providing digital compensation values;

generating compensated ink level sense values based on the ink level sense signal and the digital compensation values;

calculating the amount of ink remaining in the ink container based on the compensated ink level sense values;

and wherein the ink level sense signal is provided by a pressure sensor.

15. The method of claim 14, wherein the pressure sensor is a strain gauge bridge.

16. The method of claim 14, wherein the digital compensation values are based on characteristics of the pressure sensor.

17. A method for determining an amount of ink remaining in an ink container installed in a printing system having an inkjet printhead for receiving ink from the ink container and selectively depositing ink drops on print media, the method comprising:

providing an ink level sense signal that is indicative of a sensed volume of ink in the ink container;

providing digital compensation values;

generating compensated ink level sense values based on the ink level sense signal and the digital compensation values;

calculating the amount of ink remaining in the ink container based on the compensated ink level sense values;

and wherein at least a portion of the digital compensation values are determined after the ink container is installed in the printing system.

18. A method for determining an amount of ink remaining in an ink container installed in a printing system having an inkjet printhead for receiving ink from the ink container and selectively depositing ink drops on print media, the method comprising:

providing an ink level sense signal that is indicative of a sensed volume of ink in the ink container;

providing digital compensation values;

generating compensated ink level sense values based on the ink level sense signal and the digital compensation values;

calculating the amount of ink remaining in the ink container based on the compensated ink level sense values;

and wherein the digital compensation values represent offset correction data, gain adjustment data, and linearization correction data.

* * * * *